US006357675B1

(12) United States Patent
Schorn et al.

(10) Patent No.: US 6,357,675 B1
(45) Date of Patent: Mar. 19, 2002

(54) SANITARY ARTICLE, PARTICULARLY HAND-OPERATED SHOWER, WITH A CHANGEOVER DEVICE FOR CONTROLLING A LIQUID FLOW

(75) Inventors: Franz Schorn, Schiltach; Gerd Blessing, Villingen-Schwenningen-Obereschach, both of (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 09/483,442

(22) Filed: Jan. 14, 2000

(51) Int. Cl.[7] ..... E03C 1/08; B05B 1/30

(52) U.S. Cl. ..... 239/428.5; 239/311; 239/369; 239/361; 239/419.5; 239/569

(58) Field of Search ..... 239/311, 369, 239/361, 419.5, 428.5, 569

(56) References Cited

U.S. PATENT DOCUMENTS

| | | | | |
|---|---|---|---|---|
| 2,316,832 A | | 4/1943 | Aghnides | |
| 2,565,554 A | | 8/1951 | Goodrie | |
| 3,322,352 A | | 5/1967 | Alcantara | |
| 3,338,173 A | | 8/1967 | Gunzel et al. | |
| 3,524,591 A | | 8/1970 | Samuels et al. | 239/428.5 |
| 4,072,270 A | | 2/1978 | Harmony | |
| 4,573,639 A | | 3/1986 | Logue | |
| 4,629,124 A | * | 12/1986 | Gruber | 239/428.5 |
| 4,899,937 A | | 2/1990 | Haruch | 239/289 |
| 4,985,943 A | * | 1/1991 | Tobias et al. | 239/428.5 X |
| 5,111,994 A | | 5/1992 | Gonzales | 239/428.5 |
| 5,154,355 A | | 10/1992 | Gonzales | 239/428.5 |
| 5,348,231 A | | 9/1994 | Arnold et al. | |
| 5,495,627 A | * | 3/1996 | Leaverton et al. | 239/428.5 X |
| 6,001,250 A | | 12/1999 | Schorn et al. | 210/235 |

FOREIGN PATENT DOCUMENTS

| | | |
|---|---|---|
| CH | 473 573 | 7/1969 |
| CH | 686-409 | 3/1996 |
| DE | 43 30 651 A1 | 3/1995 |
| GB | 2 298 808 | 3/1996 |
| WO | WO 98 02 250 A1 | 1/1998 |

* cited by examiner

*Primary Examiner*—Robin O. Evans
(74) *Attorney, Agent, or Firm*—Duane, Morris, LLP

(57) ABSTRACT

A description is given of a sanitary article or object, particularly a hand-operated shower, having a changeover device (2) for controlling a liquid flow, the sanitary article having a liquid inlet and a liquid outlet, as well as an air suction device which can be turned on or off by operating the changeover device in the manner of a water jet pump. The changeover device is so constructed that a passage cross-section formed between the liquid inlet (6) and liquid outlet (7) can be widened on turning off the air suction device. For this purpose, in addition to the pump jet opening (38) of the air suction device, it is possible to open a ring channel-like, further passage cross-section (30) arranged concentrically thereto. Whereas with the air suction device turned on and limited water consumption it is possible to produce a highly aerated, soft-feeling water jet, with the air suction device turned off roughly twice the water quantity can be delivered in the form of a powerful water jet suitable for massaging purposes.

42 Claims, 2 Drawing Sheets

Figure 1:
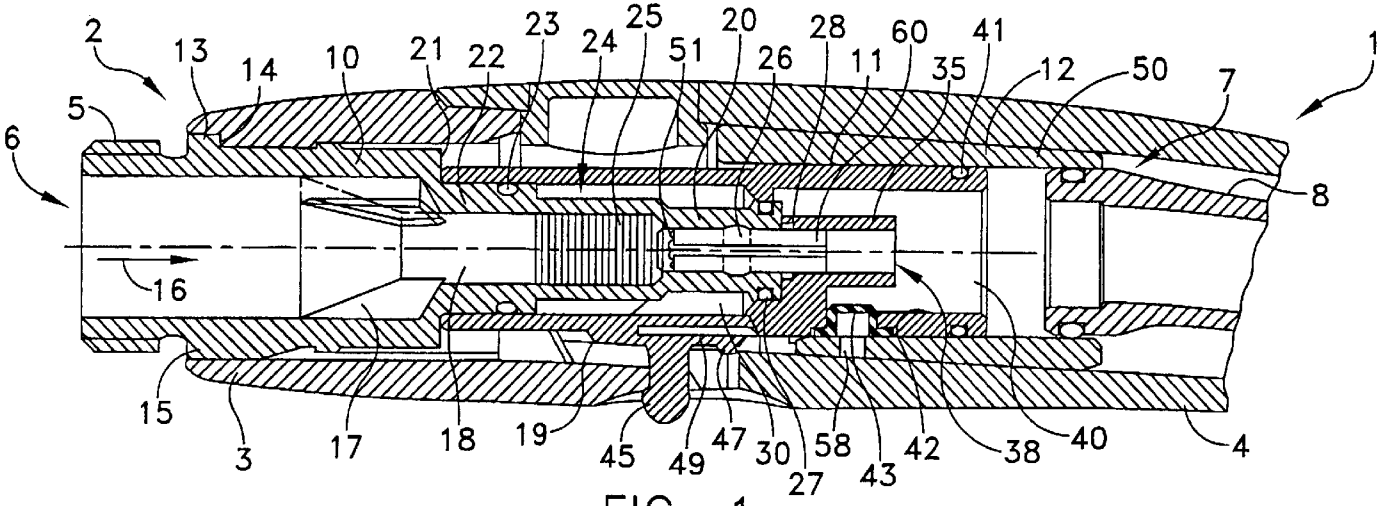

SANITARY ARTICLE, PARTICULARLY HAND-OPERATED SHOWER, WITH A CHANGEOVER DEVICE FOR CONTROLLING A LIQUID FLOW

The invention relates to a sanitary article or object, particularly a hand-operated shower, having a changeover device for controlling a liquid flow.

It is known in the case of liquid-conducting sanitary articles to use the principle of a water jet pump in order to admix sucked-in air with liquid flowing from a liquid inlet to a liquid outlet. An air suction or intake device provided for this purpose has at least one pump jet opening connectable to the liquid inlet and which issues into a pump chamber connectable by at least one air supply channel to the environment. The liquid passing out through the pump jet opening entrains air, which is mixed with the liquid and together with the latter passes out at the outlet side e.g. as a gentle, bubbling water jet. A vacuum is produced in the pump chamber or air supply channel which brings about the suction of the air for as long as liquid flows at an adequate speed through the pump jet opening and the air supply channel is open.

Permanently operating devices of this type e.g. exist in so-called water jet aerators or jet regulators, which are fitted to the outlet end of water taps. Also in the case of head showers air suction devices are known, such as e.g. the head showers described in U.S. Pat. Nos. 5,111,994 and 5 154 355.

CH-A-473 573 discloses a hand-operated shower, in which a water jet pump is so combined with a device for injecting additional substances into the flowing liquid that both devices can be simultaneously turned on or off. In the grip or handle of the hand-operated shower is provided a displaceable water supply pipe, which has a venturi tube-like constriction, into which issues an injection line, which can be linked with a storage chamber for a cleaning medium. The displaceable water supply pipe forms with the outlet-side end thereof the pump jet opening. It is displaceably guided in a cylindrical channel of the grip, which in the vicinity of the pump jet opening has radial air supply openings, which can be covered or freed as required through an axial displacement of the displaceable water supply pipe. In one position with the air supply openings freed the injection channel is connected to the cleaning medium supply, so that cleaning medium is sucked into the area of the constriction. In the vicinity of the following water jet pump air is supplied for foaming purposes.

The hand-operated shower known from CH-A-686 409 is provided in the grip with a water supply pipe with a flow limiting nozzle forming a pump jet opening and which issues into a widening pump chamber, to which is connected a conically widened pressure build-up and mixing chamber. Into the pump chamber also issues an air supply pipe coming from the outside, whose inlet opening located on the grip underside can be closed manually or by means of a slide or slide valve. The hand-operated shower is intended, despite the reduced water consumption, to form a powerful, effervescing water-air jet, whose water flow quantity is to remain relatively constant independently of the air quantity supplied in regulatable manner by a slide.

The problem of the invention is to provide a sanitary article, particularly a hand-operated shower with a changeover device and which leads to improved use.

To solve this problem the invention proposes a changeover device having the features of claim 1.

A sanitary article according to the invention is characterized in that a passage cross-section for the liquid formed between the liquid inlet and liquid outlet of the changeover device can be widened or extended on turning off the air suction device. Thus, when the water jet pump or air suction is switched on a smaller overall passage cross-section can be set than when the air suction device is switched off. Thus, in the suction position a water economizing effect can be obtained. The smaller passage cross-section compared with the off position can also be used for speeding up the flow of the liquid flowing through, which permits a strong pumping or suction action. Thus, on the outlet side in the suction position it is possible to produce a powerful, air-mixed, soft-feeling liquid flow. However, in the position with the air suction device completely turned off a much greater passage cross-section is available, so that on the outlet side can be delivered a substantially air-free, powerful flow, which is e.g. usable for massaging purposes.

The ratio of the large to the small passage cross-section can be more than 1.1 or 1.2 and can in particular be between approximately 1.3 and approximately 3, the flow paths and passage cross-sections preferably being dimensioned in such a way that with the water jet pump switched on less than approximately 60 to 80%, e.g. approximately only half the water quantity flowing through when the water jet pump is switched off then flows. Such a changeover possibility between a possibly hard massaging jet and a water-economizing, relaxing, bubbling soft jet can greatly increase the shower comfort particularly with hand-operated showers or showers installed in a fixed manner because, as a function of mood or needs, a user can choose between two completely different jet hardnesses, without it being simultaneously necessary to modify the jet type. The changeover device is in particular positioned upstream of jet forming means and in particular any adjusting devices for the jet type. The changeover device can be the sole changeover device for a sanitary article or can be provided in addition to further adjusting devices, e.g. in the shower head, so that additional combination possibilities are provided.

In a preferred embodiment the passage cross-section of the preferably circular pump jet opening is smaller than the passage cross-section of the preferably also circular liquid inlet and it is preferably less than 30%, particularly between approximately 5 and approximately 20% of the passage cross-section of the liquid inlet. Thus, in the case of a liquid-tight water conduction between the liquid inlet and the pump jet opening, a considerable acceleration of the through-flowing liquid is obtained, which even with a weak inlet pressure passes at a high speed out of the pump jet opening, so that a powerful pumping action is achieved even with an only moderately opened supply pipe. To further increase the suction or pumping action, in an embodiment a flow calming device is provided for standardizing or rendering uniform the flow passing through the pump jet opening. Upstream of the pump jet opening it can have several, preferably crosswise-arranged, axial guide rails, which encourage a laminar flow and prevent turbulence over an appropriate axial length of e.g. several millimetres to centimetres.

It is possible to design the changeover device in such a way that the water jet pump is turned off in deferred manner compared with the widening of the passage cross-section. Preferably the disconnection of the air intake and the widening of the passage cross-section take place simultaneously. In particular, on disconnecting the suction device at least one further passage channel provided in addition to the pump jet opening can b e opened. It can have a larger passage cross-section than the pump jet opening, which can then optionally be closed. However, preferably, with the air suction device disconnected both the pump jet opening and also the further passage channel can have a flow through them, so that also the passage cross-section of the pump jet opening remains usable. Thus, in cross-section particularly compact solutions are possible.

The at least one further passage channel can be positioned eccentrically to or laterally displaced with respect to the pump jet opening. A particularly effective use of limited cross-sections, e.g. in the grip of a hand-operated shower, is possible in a preferred embodiment in that the further passage channel is arranged substantially concentrically with the pump jet opening. It can in particular be constructed as an annular channel surrounding the pump jet opening.

The boundary walls of the individual passage cross-sections can be in a rigid arrangement with respect to one another and optionally separate pipes or lines can lead to the openings. The opening or closing of the passage cross-sections can be brought about by any type of closing member, such as a slide, slide valve, flap, etc. In a preferred embodiment the changeover device has a liquid-conducting, first sleeve, which is so telescopically arrangeable, particularly nestable with a separate, second sleeve that between the sleeves, at least in an axial portion, is formed an axially through-flowable annular channel or intermediate space usable as a further passage cross-section. The further passage channel can be opened or closed by an in particular axial relative displacement of the first and second sleeves. Thus, the movable in opposition, particularly axially relatively displaceable sleeves have a double function on the one hand as a liquid guide and on the other as closing members, so that there is no need for separate closing members.

Although the pump opening and the further passage channel can have separate water supplies, in a preferred embodiment a first sleeve arranged telescopically within a second sleeve has a radial flow cross-section with at least one radially through-flowable passage opening, through which the interior of the first sleeve is connectable with an intermediate space or annular space formed between the first and second sleeves. It is consequently possible to provide the sole liquid inlet of the changeover device at the first sleeve, which can e.g. have an external thread for the connection of a hose or tube. Then, through the first sleeve not only takes place the flow to the pump jet opening, but also the liquid line into the intermediate space surrounding the first sleeve and which forms the further passage cross-section when the air supply is disconnected.

The air supply channel can be formed by any suitable, optionally branched or multichannel cavity arrangement permitting an interruptable suction of air into the pump chamber. It can be bounded by separate pipe sections and/or by suitably spaced components of the changeover device and/or by channel walls provided within solid components and is preferably flow-favourably dimensioned in such a way that unintentional noise production during air intake is substantially prevented. Closing can be brought about by any suitable closing member, e.g. a slide. In a preferred embodiment a simultaneous opening of the further passage cross-section and closing of the air supply channel is made possible in that the latter can be opened or closed by the relative displacement of two telescopically arranged sleeves. For this purpose the air supply channel preferably has a first channel section constructed as a wall opening of a sleeve and which is movable relative to a second channel portion constructed as a wall opening of the other sleeve between positions with and without cross-sectional overlap of the channel sections. If the channel sections are completely mutually displaced, then the air supply channel is interrupted, whereas with an at least partial cross-sectional overlap the channel sections communicate and air can be sucked in.

In at least one of the sleeve wall openings can be inserted a preferably rubber-like valve body, which in the closed position brings about a sealing of the mutually displaced sleeves in the wall opening area and in the open position forms a valve seated in the suction channel. The latter preferably automatically opens in the suction direction, but automatically closes in the opposite direction, in order to reliably prevent an undesired escape of water through the air supply channel. In a preferred embodiment a suitable lip valve is provided for this purpose.

The presence of a vacuum in the pump chamber or in the air supply channel with the water jet pump switched on can be advantageously used for other purposes. Thus, in a preferred embodiment with the air supply channel or the pump chamber is associated at least one vacuum-activatable, acoustic signal generator, which can e.g. be constructed in such a way that as a result of the air flowing in in the case of a vacuum one or more laminations are made to audibly vibrate. This can e.g. create a preferably multitonal "shower harmonica", which for large and small children can increase the enjoyment of taking a shower in a crafty manner. Such acoustic signal generators can be provided in all sanitary articles, particularly hand-operated showers provided with air suction devices operating according to the water jet pump principle.

Although changeover devices according to the invention can be integrated in fixed form in corresponding sanitary articles, in a preferred embodiment, the changeover device is replaceable, preferably without tools, so that, if desired, the sanitary article can be operated without a changeover device or water jet aeration. In particular, the changeover device can be integrated or is integratable into the grip of a hand-operated shower. For this purpose the grip can have two axial grip sections, which can be locked together or released from one another without tools in the manner of a high-speed coupling. The nestable sleeves of the changeover device, preferably sealable against one another by 0-seals can in an appropriate manner firstly be introduced into the associated grip sections and then on assembling the grip can be slid into one another, so that the installation of the changeover device can take place simultaneously with the assembly of the grip sections. In a correspondingly simple manner it is possible to remove the changeover device from the grip for replacement purposes or for repair or cleaning.

According to the invention the sanitary article, particularly if constructed as a shower, can be provided with a cleanable filter. The filter is preferably in the form of a sleeve-like filter through which there can be a radial flow from the inside or the outside and against which a radial flow takes place and which is releasably closed at its downstream end. Through opening the closure there can be an axial flow through the filter for cleaning purposes. For cleaning purposes the filter is preferably detachable from the sanitary article. The axial closure or seal is advantageously constituted by a part remaining on the sanitary article on detaching the filter, so that the axial closure on removing the filter is automatically detached from the latter which can be axially open. Thus, the filter can be cleaned in the state released from the sanitary article, so that there is no risk of residues remaining in the filter passing into the sanitary article. In a further, advantageous development the water connection, e.g. a hose connection, is permanently connected to the filter, so that the normal water connection can be used for a flow through the filter for cleaning purposes. This filter construction is not only advantageous with the presently described sanitary article, but also for other sanitary articles, particularly showers, such as hand-operated showers.

These and other features of the invention can be gathered from the following description of a preferred embodiment in conjunction with the subclaims and drawings. The individual features can be implemented either singly or in the form of combinations. In the drawings show:

FIG. 1 A longitudinal section through a preferred embodiment of an inventive changeover device fitted in a hand-operated shower in a position with the air suction device turned on and the water passage constricted.

Figure 2:
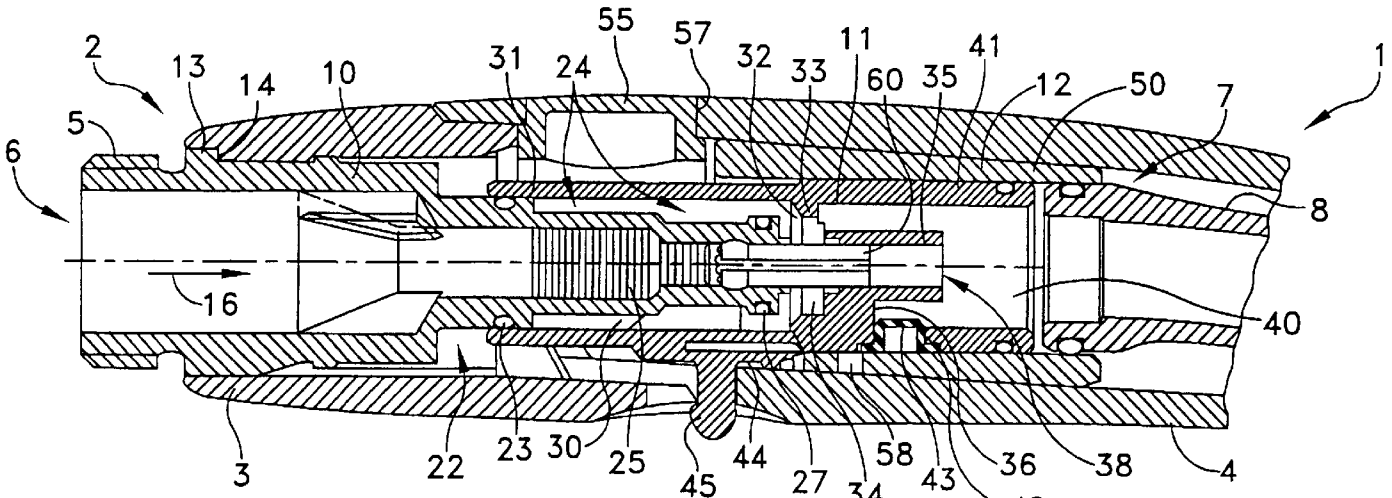

FIG. 2 The changeover device according to FIG. 1 with disconnected air suction device and unconstricted water passage.

Figure 3:
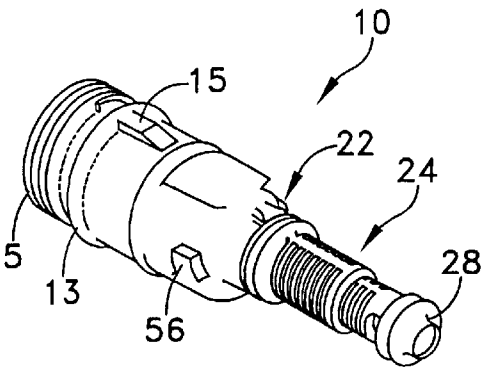

FIG. 3 A perspective view of a hose connection sleeve of the changeover device according to FIGS. 1 and 2.

Figure 4:
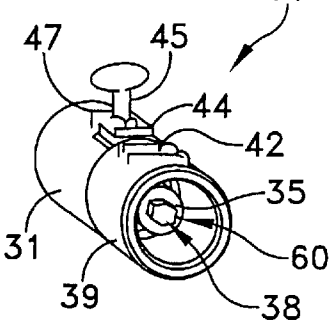

FIG. 4 A perspective view of a slide sleeve of the changeover device of FIGS. 1 and 2.

Figure 5:
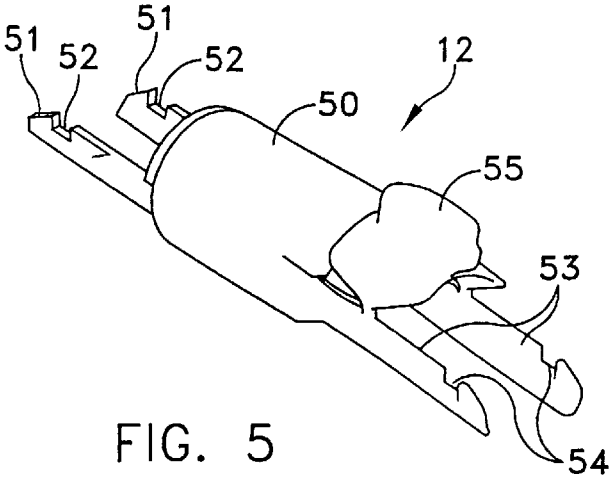

FIG. 5 A perspective view of a guide sleeve of the changeover device of FIGS. 1 and 2.

Figure 6:
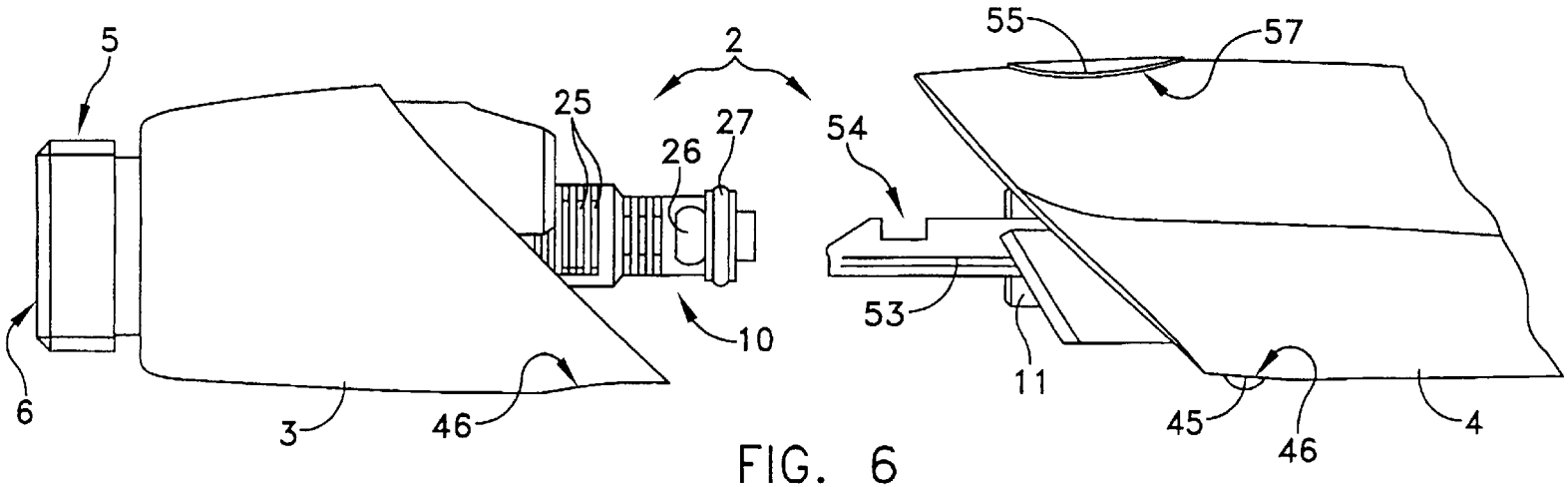

FIG. 6 A side view of the rear end portion of a grip of a hand-operated shower with inserted sleeves of the changeover device prior to the assembly of the grip and the changeover device.

The axial longitudinal section of FIG. 1 shows the rear, hose-facing part of a shower grip 1, which has a hollow cavity in which is inserted a preferred embodiment of an inventive changeover device 2. The grip has a hose-facing, rear grip section 3 and a front grip section 4 facing the not shown shower head and constructed in one piece therewith. The casing parts 3, 4 injection moulded from impact-resistant, readily chromium-platable plastic (ABS) have complimentary shaped faces (FIG. 6), which face one another and are bevelled by approximately 45° and which when the grip is assembled define a butt joint passing in inclined manner around the latter. When the changeover device 2 is inserted and the grip I assembled the latter is screwed by means of a hose connection external thread 5 to the front end of a shower hose provided with a suitable cap nut. When the water supply is turned on the water passes through the circular liquid inlet 6 in the threaded area into the outwardly sealed interior of the changeover device and through the latter to its circular liquid outlet 7 and from there via a water conducting channel 8 placed inside the front grip section 4 and inserted in sealed manner in the liquid outlet area 7, into the vicinity of the not shown shower head.

The changeover device 2 essentially comprises three telescopically nestable, sleeve-like plastic components 10, 11, 12, which are perspectively shown in FIGS. 3 to 5. The first sleeve 10 constructed as a hose connecting sleeve shown in FIG. 3 has at the inlet side the hose connection thread 5 and the liquid inlet 6 and is inserted from the hose side up to the stop provided by a collar 13 on a bearing shoulder 14 of the grip section 3 into the latter and is located in the latter in non-rotary manner when inserted, because an axial web 15 engages in a corresponding axial groove of the grip section 3. It has a substantially circular internal cross-section or passage cross-section, which in the flow direction 16 tapers in two, spaced succeeding steps. A first tapering step connected to a circular cylindrical, inlet-side section passes via conical or zonally planar funnel faces to a central section 18, which has approximately 25% of the passage cross-section of the liquid inlet 6, and a second step 19 with conical funnel faces leads into a cylindrical, smaller diameter outlet section 20, whose passage crosssectional surface is less than half the central section 18 or approximately 9% of the cross-section in the inlet area 6. Thus, a liquid flowing into the liquid inlet 6 is strongly accelerated in two stages and following the acceleration stages there are diameter-constant sections for calming the flow. The external diameter of the first sleeve 10 is also reduced stepwise, so that cylindrical sections of different external diameter follow one another accompanied by the formation of radial or sloping radial steps. Following onto the external section dimensioned for fitting into the rear casing part 3, is formed a cylindrical sealing section 22, accompanied by the formation of a radial bearing shoulder 21, in which is provided a circumferential annular groove for receiving an 0-seal 23. Downstream is connected a smaller external diameter radial flow section 24 serving as a filter, in whose sleeve wall there are several narrow, axially spaced passage openings 25 constructed as radial slots. Thus, there can be a radial flow through the sleeve wall in the vicinity of the radial flow section 24. The following, smaller diameter, cylindrical outlet section 20 also contains slot-like radial openings and a pair of facing, cross-sectionally larger, rectangular radial openings 26. In the end region of the outlet section 20 there is an external diameter increase, in which there is a further annular groove with an O-seal 27. The outlet-side termination of the first sleeve is formed by a thin-walled, cylindrical connecting piece 28. The sleeve body 10 made from bending-resistant plastics material, particularly polyoxymethylene is rigidly connected to the grip casing in the inserted state.

When the changeover device is assembled the first sleeve 10 is telescopically inserted in a second sleeve 11 (FIG. 4) in such a way that both sleeves are axially displaceable against one another in sealed form in the vicinity of the sealing section 22, whereas in the area of the radially through-flowable openings 25, 26 of the inner sleeve 10 between the latter and the outer, second sleeve is left an intermediate or annular space 30. The second sleeve 11 constructed as an axial slide is provided downstream of the cylindrical section 31 serving as an external boundary for the annular space 30 or as a guiding and sealing surface, an inwardly projecting collar 33, accompanied by the formation of a sloping surface 32, which has a cylindrical inner face 34, which cooperates as a sealing surface with the O-seal 27 of the first sleeve in such a way that the in FIG. 1 shown slide position of the annular space 30 is sealed in the water flow direction or axially, whereas it is axially open in the position shown in FIG. 2.

Downstream of the collar 33 in the interior of the sleeve 11 is provided a concentric, smaller sleeve 35, which is connected by means of a unilateral holding web 36 to the outer sleeve wall. The guide sleeve 35 arranged in the extension with the cylindrical outlet section 20 of the first sleeve has the same internal diameter as the cylindrical outlet section 20 and facing the latter has a diameter widening constructed for receiving the connecting piece 28, in which the latter is so inserted in the closed position of FIG. 1 that the sleeve 35 forms a stepless extension of the cylindrical outlet section 20. To the movable sleeve 35 or slide 11 can be fixed a guide body insertable in lateral clearance-free manner into the cylindrical outlet section 20 of the first sleeve and which forms at its upstream, free end a plunger 61 insertable in piston-like manner into the outlet channel 20 and several, e.g. four, axially directed webs, which subdivide the cylindrical guide channel into four partial channels of correspondingly smaller diameter. As a result of the clearance-free insertion there is an axial guidance for the end section of the first sleeve projecting freely into the interior of the grip section.

The circular outlet opening 38 of the sleeve 35 issues into an air suction chamber 40, bounded by the cylindrical wall 39 of the second sleeve 11 and whose liquid outlet 7 has the same cross-section as the liquid inlet 6 of the sleeve 10. In the vicinity of the liquid outlet 7 on the outside of the cylinder wall 39 is provided a circumferential groove for receiving an o-seal 41, which cooperates as a sealing surface with a cylindrical inner face of a third sleeve 12. Below the central sleeve 31 is formed a radially through, cylindrical sleeve wall opening 42, in which is inserted a cup-shaped, rubber-like valve body 43 in the form of a lip seal. On the under-side of the slide 11 is formed an axial spring tongue 44, which carries a radially projecting, T-shaped actuator 45, which projects out of the under-side of the grip in the vicinity of the grip depression 46 of the casing wall 3, 4 when the changeover device is inserted.

The third sleeve 12 shown in FIG. 5 is constructed as an outer guide sleeve for the slide 11. It has a substantially cylindrical sleeve section 50, whose internal diameter is adapted to the external diameter of the second sleeve and whose outer contour is so dimensioned that the sleeve can be inserted in substantially clearance-free manner into the front grip casing section 4. On the underside of the sleeve section is formed a radially through sleeve wall opening 58 for cooperating with the slide wall opening 42. Two resilient, axial brackets 51 oriented towards the shower head and constructed in one piece on the cylindrical section 5 engage laterally on the water guide channel 8 and holding projections provided there lock in locking recesses 52 of the brackets. On the axially facing side there are two further resilient, axial brackets 53 with locking recesses 54. On the brackets and spaced from the cylindrical section 50 is provided a pushbutton 55 linking the brackets and which on inserting the third sleeve 12 in the grip section 4 locks in a corresponding recess 57 on the top of the grip section 4, in order to fix the third sleeve 12 in such a way that it cannot be lost in the front grip section 4. On assembling the grip with the changeover device the brackets 53 lock by means of the recess 54 on correspondingly shaped locking projections 56 of the first sleeve 10 and consequently axially positively link the first and third sleeves, so that the casing sections 3 and 4 are also axially fixed to one another. For releasing the locking connection it is merely necessary to operate the pushbutton 55 and to draw apart the now freed parts 3 and 4 or 10 and 12.

As shown in FIG. 6, for fitting the changeover device in the grip of a hand-operated shower, the guide tube 12 can be inserted in the front grip section 4 until the pushbutton 55 locks in the upper casing opening 57. The first sleeve 10 is inserted from the hose connection side in the rear grip section 3 and is fixed. The slide 11 can then be inserted into the third sleeve 12. Accompanied by the engaging of the sleeve 11 on the hose connection pipe 10, the grip parts can be axially slid onto one another until the brackets 53 lock on the first sleeve 10 and the sleeve parts 10 and 12 of the changeover device or parts 3 and 4 of the grip are axially fixed to one another. The shower hose can then be screwed to the hose connection sleeve 5. The shower is then ready to operate and can be switched by manual displacement in the axial direction of the slide 11 between the constricted position shown in FIG. 1 with a reduced flow cross-section and connected in water jet pump and the passage position shown in FIG. 2 with disconnected water jet pump and increased passage cross-section.

In the constricted position shown in FIG. 1 the slide or dimmer 11 is retracted towards the hose connection end until it strikes against the shoulder 21. The O-seal 27 comes into sealing engagement with the cylindrical surface 34 of the collar 33 and axially seals the annular space 30. The water flowing in through the liquid inlet 6 is accelerated by the diameter reduction in area 17 and flows into the vicinity of the radial passage openings 25. When the guide body 60 is present and whose plunger section 61 closes the cylindrical outlet section 20 in the manner of a piston, the water flows through the filter slots 25 radially outwards into the annular space 30 and from there through the rectangular opening 26 radially inwards back to the cylindrical section 20 and along the guide bars of the body 60 bringing about a flow calming and standardizing, through the sleeve 35 to its outlet opening 38. As a result of the double, radial deflection of the entire water flow in the area of the radial openings 25, 26 a dynamic constricting action is achieved. This is intensified in that the outlet opening 38 only has approximately 9% of the passage surface of the liquid inlet 6. The cross-sectional reduction in the flow path leads to the water spraying at high speed out of the outlet opening 38 acting as a water jet pump opening into the following cavity 40.

The pump chamber or cavity 40 in the slide position shown is connected by means of the sleeve wall opening 42 of the slide and the aligned, somewhat smaller sleeve wall opening 58 of the guide sleeve 12 and a not shown axial channel between the guide sleeve and casing wall 4 to the area of the opening leading into the exterior for the actuating lever 45. As a result of the thus formed air supply channel air is sucked by means of the valve 43 in the passage position into the pump chamber 40, is mixed there and further down-stream with the sprayed in water and in the vicinity of the shower head passes out together with the water in the form of a bubbling, soft-feeling water jet. With conventional water pressures the constriction means that in the constricted position typically approximately 9 to 10 litres of water flow per minute through the changeover device. The water pressure load on the slide 11 means that in the case of a free forward mobility, i.e. away from the first sleeve, it would be displaced. This automatic displacement is counteracted in that the slide locks in with the position with the opened air supply channel on the casing. For this purpose the spring tongue 44 has a downwardly projecting detent 47, which in the constricted position (FIG. 1) is located in the vicinity of the passage opening for the lever 45 and is forced downwards by the tension of spring 44, so that an automatic displacement of the slide in the forwards direction is prevented by the detent 47 striking against casing 4.

When the water supply is turned on, the slide 11 can be switched from the constricted position with air supply (FIG. 1) into the unconstricted passage position (FIG. 2) through the actuator 45 being forced inwards. Thus, the detent 47 is disengaged from the casing wall 4 and, under the influence of the water pressure, the slide 11 can automatically slide forwards until the lever 45 strikes against the casing wall 4. Through the axial displacement of the slide 11 over a few millimetres with respect to the casing-fixed sleeves 10 and 12 the sealing engagement between the first sleeve 10 and the slide 11 is interrupted in the area of the front seal 27, 34, so that in this area is created an axial passage between the annular space 30 and the downstream pump chamber 40. Simultaneously the channel sect ion of the air supply channel formed by the sleeve wall opening 42 is so far axially displaced with respect to the channel section formed by the wall opening 58 that the channel sections no longer overlap and the air supply channel is closed in air-tight manner. An outflow of water from the pump chamber 40 through the air supply channel to the outside is prevented by the lip seal 43, which is impermeable in this direction and consequently prevents leaks.

In the unconstricted position two passage cross-sections or a much larger passage cross-section compared with the constricted position is available to the water exclusively flowing in through the first sleeve 10. The inflowing water passes via the radial opening 25 into the area of the annular space 30. A partial quantity can flow through the rectangular openings 26 into the area of the guide body 60 and from there through the sleeve 35 to the pump jet openings 38 or, whilst bypassing the sleeve 35, to the liquid outlet 7. However, the normally larger proportion in accordance with the flow resistance conditions flows through the further passage cross-section formed in the area of the collar 33, accompanied by the partial bypassing of the sleeve 35 on the outside thereof to the outlet 7 and part can flow through the sleeve 35 to said outlet 7. Thus, apart from the passage cross-section formed by the pump jet opening 38, a further passage cross-section arranged concentrically around it is available for the water. The partial flows flowing through the separate passage cross-sections combine in the pump chamber 40 and flow together through the liquid outlet 7 or the water conducting channel to the shower head. The total passage cross-section can be such that for conventional water pressures approximately 20 litres per minute flow through the changeover device. Thus, on the outlet side, per unit of time, roughly twice the substantially air-free water quantity is available as compared with the constricted position shown in FIG. 1.

Thus, whereas in the constricted position (FIG. 1) in water-economizing manner a soft, strongly air-enriched and mixed water flow can be delivered, in the unconstricted position (FIG. 2) a comparatively powerful, air-free water flow can be delivered, which is e.g. usable for massaging purposes.

The principle of connecting in a further passage cross-section when the water jet pump is disconnected explained by means of a preferred embodiment can also be implemented in numerous other ways. For example, the guide body 60 used for jet calming and mutual guidance of the sleeves 10 and 11 can be omitted, as can the central sleeve 35 in slide 11. It is also possible to fix one sleeve in the manner of a slide 11 and to have another sleeve displaceable with respect to the same. A changeover can optionally also be achieved by mutually turning sleeves or other elements. To reduce the noise produced by the sanitary fitting downstream of the changeover device can be provided a sound damping device, e.g. in the form of a sound-damping foam filling in the area between the water conducting channel 8 and the casing wall 4. Sound deadening measures can also be provided in the air supply channel, e.g. by filling a section with open-cell foam. The vacuum produced according to the water jet principle can also be utilized for admixing liquid additives, such as soaps or other cleaning agents with the through-flowing water. The use of such changeover devices on hand-operating showers is also not prescribed. Thus, changeover devices according to the invention can also be used on fixed installed showers or water taps on hand washbasins or the like.

As has already been stated, the sleeve 10 having the hose connection 5 and radial flow section 24 serving as a filter can be constructed in removeable manner with respect to the remaining components of the sanitary article or hand-operated shower. On separating sleeve 10 and slide 11, the guide body 60 with the piston-like plunger is removed from the radial flow section 24 or outlet section 20, so that it no longer closes the axial passage opening thereof. Any particles retained in the filter can consequently easily be axially flushed out and consequently the filter is cleaned.

What is claimed is:

1. Sanitary article comprising a changeover device for controlling a liquid flow, the changeover device comprising a liquid inlet, a liquid outlet and an air suction device operable in the manner of a water jet pump, wherein the air suction device is turned on or off by operating the changeover device, the air suction device comprising at least one pump jet opening connectable to the liquid inlet and issuing into a pump chamber, the pump chamber being connectable by means of at least one air supply channel to the exterior of the sanitary article, wherein there is formed a passage cross-section between the liquid inlet and the liquid outlet and wherein the passage cross-section can be widened on turning off the air suction device.

2. Sanitary article according to claim 1, wherein, on turning off the suction device, the passage cross-section can be increased to more than 1.5 times the passage cross-section as compared with a turned on air suction device.

3. Sanitary article according to claim 1, wherein the passage cross-section can be widened in such a way that a water quantity passing through the passage cross-section per unit of time with the air suction device turned off is approximately 1.5 to 3 times as large as when the air suction device is turned on.

4. Sanitary article according to claim 1, wherein the passage cross-section of the pump jet opening is smaller than the passage cross-section of the liquid inlet and is less than 30% of the passage cross-section of the liquid inlet.

5. Sanitary article according to claim 1, wherein a flow calming device is provided for standardizing the flow passing through the pump jet opening.

6. Sanitary article according to claim 1, wherein with the turning off of the air suction device at least one further passage channel is provided in addition to the pump jet opening.

7. Sanitary article according to claim 6, wherein the pump jet opening can be opened with the air suction device turned off such that there is provided a flow through the pump jet opening and the further passage channel.

8. Sanitary article according to claim 6, wherein the further passage channel is arranged substantially concentrically to the pump jet opening.

9. Sanitary article according to claim 1, wherein the changeover device comprises a liquid conducting first sleeve which is so telescopically arrangeable with respect to a separate second sleeve that at least in an axial section an axially through-flowable intermediate space is formed between the first sleeve and the second sleeve.

10. Sanitary article according to claim 6, wherein the further passage channel can be opened or closed by a relative displacement of a first sleeve and a second sleeve of the changeover device, wherein the first sleeve and the second sleeve are arranged telescopically with respect to another.

11. Sanitary article according to claim 1, wherein the changeover device comprises a first sleeve positioned telescopically within a second sleeve of the changeover device and wherein the first sleeve comprises a radial flow section comprising at least one radially through-flowable passage opening, through which the interior of the first sleeve can be linked in flow-conducting manner with an intermediate space formed between the first sleeve and the second sleeve.

12. Sanitary article according to claim 1, the sanitary article comprising a first sleeve forming the liquid inlet and having an internal diameter which is narrowing in the flow direction and an external diameter which is decreasing in the flow direction.

13. Sanitary article according to claim 12, wherein the first sleeve comprises a sealing section which is introducable in sealing manner into a second sleeve of the changeover device such that the first sleeve is axially movable with respect to the second sleeve.

14. Sanitary article according to claim 13, wherein downstream of the sealing section there is provided a radial flow section with at least one radially through-flowable passage opening.

15. Sanitary article according to claim 11, wherein downstream of a radial flow section the first sleeve comprises a sealing section cooperating with a sealing surface of a second sleeve surrounding the first sleeve such that a sealing engagement can be brought about or set aside by an axial relative displacement of the first sleeve and the second sleeve.

16. Sanitary article according to claim 15, wherein the sealing section is provided with at least one circumferential O-seal.

17. Sanitary article according to claim 1, wherein the changeover device comprises a second sleeve nestable telescopically with a first sleeve of the changeover device, the second sleeve being axially displaceable with respect to at least one further element of the sanitary device, wherein the further element is at least one of the group comprising the first sleeve, a second sleeve and a housing of the sanitary article.

18. Sanitary article according to claim 17, wherein the second sleeve is dimensioned in such a way that it sealingly surrounds the first sleeve in the vicinity of the sealing section in the case of an axial relative displacement and with radial spacing in the vicinity of the radial flow section for forming an annular channel.

19. Sanitary article according to claim 18, wherein the annular channel can be opened or closed downstream of the radial flow section by an axial relative displacement of the first sleeve and the second sleeve.

20. Sanitary article according to claim 1, wherein the changeover device comprises a third sleeve constructed as an axial guide for a second sleeve such that the second sleeve and the third sleeve are axially displaceable with respect to one another.

21. Sanitary article according to claim 20, wherein the third sleeve is constructed for fixing to a casing part of the sanitary article.

22. Sanitary article according to claim 21, wherein the third sleeve can be inserted i n and locked with the casing part.

23. Sanitary article according to claim 20, wherein the third sleeve comprises a locking member in the form of a locking button traversing an opening of a casing part.

24. Sanitary article according to claim 20, wherein the third sleeve can be fixed without tools to the first sleeve.

25. Sanitary article according to claim 24, wherein the first sleeve and the third sleeve form an axial guide for the second sleeve displaceable relative to said first and third sleeve.

26. Sanitary article according to claim 1, wherein the air supply channel can be opened or closed by a relative displacement of two telescopically arranged sleeves.

27. Sanitary article according to claim 26, wherein the air supply channel comprises a first channel section constructed as a wall opening of a sleeve and which is movable relative to a second channel section constructed as a wall opening of the other sleeve, wherein the wall openings comprise cross-sections and wherein by relative displacement of the first channel section and the second channel section the channel sections can be moved between positions with and without a cross-sectional overlap of the channel sections.

28. Sanitary article according to claim 27, wherein at least one of the sleeve wall openings is provided with a valve member.

29. Sanitary article according to claim 28, wherein the valve member is constructed in the form of a rubber-like lip seal inserted in the sleeve wall opening.

30. Sanitary article according to claim 1, wherein in the air supply channel is placed at least one valve automatically opening in a suction direction and automatically closing in the opposite direction.

31. Sanitary article according to claim 1, wherein with the air supply channel is associated at least one accoustic signal generator activatable by a vaccum.

32. Sanitary article according to claim 1, wherein the changeover device is fittable without tools and in replaceable manner on the sanitary article.

33. Sanitary article according to claim 1, wherein the changeover device is placed in a grip of a hand-operated shower.

34. Sanitary article according to claim 33, wherein the grip comprises two axially engagable grip sections dimensioned for receiving at least one part of the changeover device upon connecting the grip sections.

35. Sanitary article according to claim 1, wherein the changeover device is located in replaceable manner in a grip of a hand-operated shower.

36. Sanitary article according to claim 1, wherein upstream of the pump jet opening is located a water filter comprising passage openings that are smaller than passage openings of the pump jet opening.

37. Sanitary article according to claim 36, wherein the passage openings of the water filter are smaller than passage openings of jet forming means of the sanitary article.

38. Sanitary article according to claim 36, wherein the water filter comprises a filter surface which is formed by a radially through-flowable sleeve, wherein a down-stream end of the water filter is releasably closed in the operating state and is constructed such that there can be an axial flow through the water filter for cleaning the water filter.

39. Sanitary article according to claim 36, wherein the water filter is constructed as a radial flow section comprising passage slots acting as passage openings of the water filter.

40. Sanitary article according to claim 36, wherein the water filter is constructed such that it is removable from the sanitary article accompanied by axial opening and in the removed state there can be an axial flow through the water filter for cleaning purposes.

41. Sanitary article according to claim 1, wherein the sanitary article is constructed as a hand-operated shower.

42. Sanitary article comprising a changeover device for controlling a liquid flow, the changeover device comprising a liquid inlet, a liquid outlet and an air suction device operable in the manner of a water jet pump, wherein the air suction device is turned on or off by operating the changeover device, the air suction device comprising at least one pump jet opening connectable to the liquid inlet and issuing into a pump chamber, the pump chamber being connectable by means of at least one air supply channel to the exterior of the sanitary article, wherein the pump jet opening includes passage openings and upstream of the pump jet opening is located a water filter comprising passage openings which are smaller than the passage openings of the pump jet opening.

* * * * *